US011176876B1

(12) United States Patent
Lee et al.

(10) Patent No.: US 11,176,876 B1
(45) Date of Patent: Nov. 16, 2021

(54) DISPLAY DEVICE

(71) Applicant: Samsung Display Co., Ltd., Yongin-Si (KR)

(72) Inventors: Hyo Jin Lee, Yongin-si (KR); Hong Soo Kim, Yongin-si (KR); Jin Young Roh, Yongin-si (KR); Se Hyuk Park, Yongin-si (KR); Jae Keun Lim, Yongin-si (KR)

(73) Assignee: Samsung Display Co., Ltd. (KR)

( * ) Notice: Subject to any disclaimer, the term of this patent is extended or adjusted under 35 U.S.C. 154(b) by 0 days.

(21) Appl. No.: 17/151,601

(22) Filed: Jan. 18, 2021

(30) Foreign Application Priority Data

Jun. 18, 2020 (KR) ..... 10-2020-0074477

(51) Int. Cl.
*G09G 3/32* (2016.01)

(52) U.S. Cl.
CPC ..... *G09G 3/32* (2013.01); *G09G 2310/027* (2013.01); *G09G 2320/0276* (2013.01); *G09G 2320/0673* (2013.01)

(58) Field of Classification Search
CPC ..... G09G 3/32; G09G 2320/0673; G09G 2320/0276; G09G 2310/027
See application file for complete search history.

(56) References Cited

U.S. PATENT DOCUMENTS

| | | | | |
|---|---|---|---|---|
| 10,720,114 | B2 | 7/2020 | Choi et al. | |
| 2008/0068405 | A1* | 3/2008 | Kumakura | G09G 3/2944 345/690 |
| 2014/0320552 | A1* | 10/2014 | Seo | G09G 3/3648 345/690 |
| 2015/0339967 | A1* | 11/2015 | Shin | G09G 3/3666 345/690 |
| 2016/0086572 | A1* | 3/2016 | Nasiriavanaki | G09G 5/06 345/590 |
| 2019/0114971 | A1* | 4/2019 | Choi | G09G 3/2014 |

FOREIGN PATENT DOCUMENTS

| | | | |
|---|---|---|---|
| KR | 10-1569135 | B1 | 11/2015 |
| KR | 10-1761400 | B1 | 7/2017 |
| KR | 10-2019-0020265 | A | 2/2019 |

* cited by examiner

*Primary Examiner* — Andrew Sasinowski
(74) *Attorney, Agent, or Firm* — Innovation Counsel LLP

(57) ABSTRACT

A display device includes the following elements: a display panel including a first pixel emitting first-color light, a second pixel emitting second-color light, and a third pixel emitting third-color light; a controller generating generated image data based on input image data according to a driving frequency of the display panel, and generating output image data using the generated image data; and a data driver supplying data signals to the display panel based on the output image data. The input image data includes first, second, and third grayscales for the first, second, and third pixels, respectively. The generated image data includes first, second, and third generated grayscales for the first, second, and third pixels, respectively, with different ratios to the first, second, and third grayscales, respectively.

20 Claims, 14 Drawing Sheets

DISPLAY DEVICE

CROSS-REFERENCE TO RELATED APPLICATION

The present application claims priority under 35 U.S.C. § 119(a) to Korean patent application 10-2020-0074477 filed on Jun. 18, 2020 in the Korean Intellectual Property Office; the Korean patent application is incorporated herein by reference.

BACKGROUND

1. Technical Field

The technical field generally relates to a display device.

2. Related Art

A display device may include a display panel, a scan driver, and a data driver. The display panel includes scan lines, data lines, and pixels. The scan driver sequentially provides scan signals to the scan lines. The data driver provides data signals to the data lines. Each of the pixels may emit light with a luminance corresponding to a data signal provided through a corresponding data line in response to a scan signal provided through a corresponding scan line.

The display device may display a frame image at a low refresh rate (or low frequency) so as to reduce power consumption.

When the display device displays frame images at a low refresh rate or is driven at a low frequency, the time for which one frame image is displayed may be relatively lengthened. As a result, a decrease in luminance of the frame image according to elapsed time and a flicker phenomenon due to a repeated decrease in luminance may be conspicuous to a user of the display device.

SUMMARY

Embodiments may be related to a display device without a conspicuous flicker phenomenon.

An embodiment may be related to a display device. The display device may include the following elements: a display panel including a first pixel emitting light of a first color, a second pixel emitting light of a second color, and a third pixel emitting light of a third color; data lines electrically connected to the display panel; a controller configured to generate generated image data based on input image data and a frequency at which the display panel is driven, and configured to generate output image data based on the generated image data; and a data driver electrically connected to the controller, configured to generate data signals based on the output image data, and configured to supply the data signals to the display panel through the data lines. The input image data may include a first grayscale for the first pixel, a second grayscale for the second pixel, and a third grayscale for the third pixel. The generated image data may include a first generated grayscale for the first pixel, a second generated grayscale for the second pixel, and a third generated grayscale for the third pixel. A ratio of the first generated grayscale to the first grayscale, a ratio of the second generated grayscale to the second grayscale, and the third generated grayscale to the third grayscale may be different from one another.

The display panel may operate in one of a first mode in which the data signals are supplied at a first frequency and a second mode in which the data signals are supplied at a second frequency lower than the first frequency. The controller may generate the first generated grayscale, the second generated grayscale, and the third grayscale in the second mode.

The first generated grayscale, the second generated grayscale, and the third grayscale may be respectively less than the first grayscale, the second grayscale, and the third grayscale in the second mode.

A difference between the first grayscale and the first generated grayscale may increase as a magnitude of the second frequency decreases in the second mode.

When the first grayscale, the second grayscale, and the third grayscale included in the input image data are equal to one another, luminance of the first pixel, luminance of the second pixel, and luminance of the third pixel may be different from one another according to the generated image data.

The first pixel emits red light, the second pixel emits green light, and the third pixel emits blue light.

In the second mode, a difference between the first generated grayscale and the first grayscale may be greater than that between the third grayscale and the third generated grayscale, and a difference between the second grayscale and the second generated grayscale may be greater than that between the first grayscale and the first generated grayscale.

The controller may include the following elements: an image analyzer configured to generate frequency data by analyzing the frequency at which the display panel is driven, based on the input image data; and a data extractor configured to extract the first grayscale, the second grayscale, and the third grayscales included in the input image data.

The controller may include a generated data generator configured to generate the generated image data, based on the frequency data, the first grayscale, the second grayscale, and the third grayscale.

The controller may include a memory storing at least one lookup table. The generated data generator may generate the generated image data by changing the first grayscale, the second grayscale, the third grayscale based on the lookup table.

The display device may include a host processor configured to supply the input image data and frequency data to the controller, the frequency data corresponding to the frequency at which the display panel is driven. The controller may include the following elements: a data extractor configured to extract the first grayscale, the second grayscale, and the third grayscale included in the input image data; and a generated data generator configured to generate the generated image data, based on the frequency data, the first grayscale, the second grayscale, and the third grayscale.

An embodiment may be related to a display device. The display device may include the following elements: a display panel including a first pixel emitting light of a first color, a second pixel emitting light of a second color, and a third pixel emitting light of a third color; data lines electrically connected to the display panel; a controller configured to generate output image data based on input image data; a gamma voltage provider configured to provide provided gamma voltages; a gamma voltage generator configured to generate generated gamma voltages based on the provided gamma voltages according to a frequency at which the display panel is driven; and a data driver electrically connected to the gamma voltage generator, electrically connected to the controller, configured to generate data signals based on the output image data and the generated gamma voltages, and configured to supply the data signals to the display panel through the data lines. The input image data may include a first grayscale for the first pixel, a second grayscale for the second pixel, and a third grayscale for the third pixel. The provided gamma voltages include a first provided gamma voltage, a second provided gamma voltage, and a third provided gamma voltages respectively corresponding to the first grayscale, the second grayscale, and the third grayscale. The generated gamma voltages may include a first generated gamma voltage, a second generated gamma voltage, and a third generated gamma voltages respectively corresponding to the first grayscale, the second grayscale, and the third grayscale. A ratio of the first generated gamma voltage to the first provided gamma voltage, a ratio of the second generated gamma voltage to the second provided gamma voltage, and a ratio of the third generated gamma voltage to the third gamma provided voltage may be different from one another.

The display panel may operate in one of a first mode in which the data signals are supplied at a first frequency and a second mode in which the data signals are supplied at a second frequency lower than the first frequency. The gamma voltage generator may generate the generated gamma voltages in the second mode.

The first generated gamma voltage, the second generated gamma voltage, and the third generated gamma voltage may be respectively less than the first provided gamma voltage, the second provided gamma voltage, and the third provided gamma voltage in the second mode.

A difference between the first provided gamma voltage and the first generated gamma voltage may increase as the magnitude of the second frequency decreases in the second mode.

When the first grayscale, the second grayscale, and the third grayscale included in the input image data are equal to one another, luminance of the first pixel, luminance of the second pixel, and luminance of the third pixel may be different from one another according to the generated gamma voltages.

The first pixel emits red light, the second pixel emits green light, and the third pixel emits blue light.

In the second mode, a difference between the first provided gamma voltage and the first generated gamma voltage may be greater than that between the third provided gamma voltage and the third generated gamma voltage, and a difference between the second provided gamma voltage and the second generated gamma voltage may be greater than that between the first provided gamma voltage and the first generated gamma voltage.

The gamma voltage generator may include the following elements: an image analyzer configured to generate frequency data by analyzing the frequency at which the display panel is driven, based on the input image data; and a data extractor configured to extract the first grayscale, the second grayscale, and the third grayscale included in the input image data.

The generated gamma voltage generator may be configured to generate the first generated gamma voltage, the second generated gamma voltage, and the third generated gamma voltage according to the first grayscale, the second grayscale, and the third grayscale and based on the frequency data.

DETAILED DESCRIPTION

Figure 1:
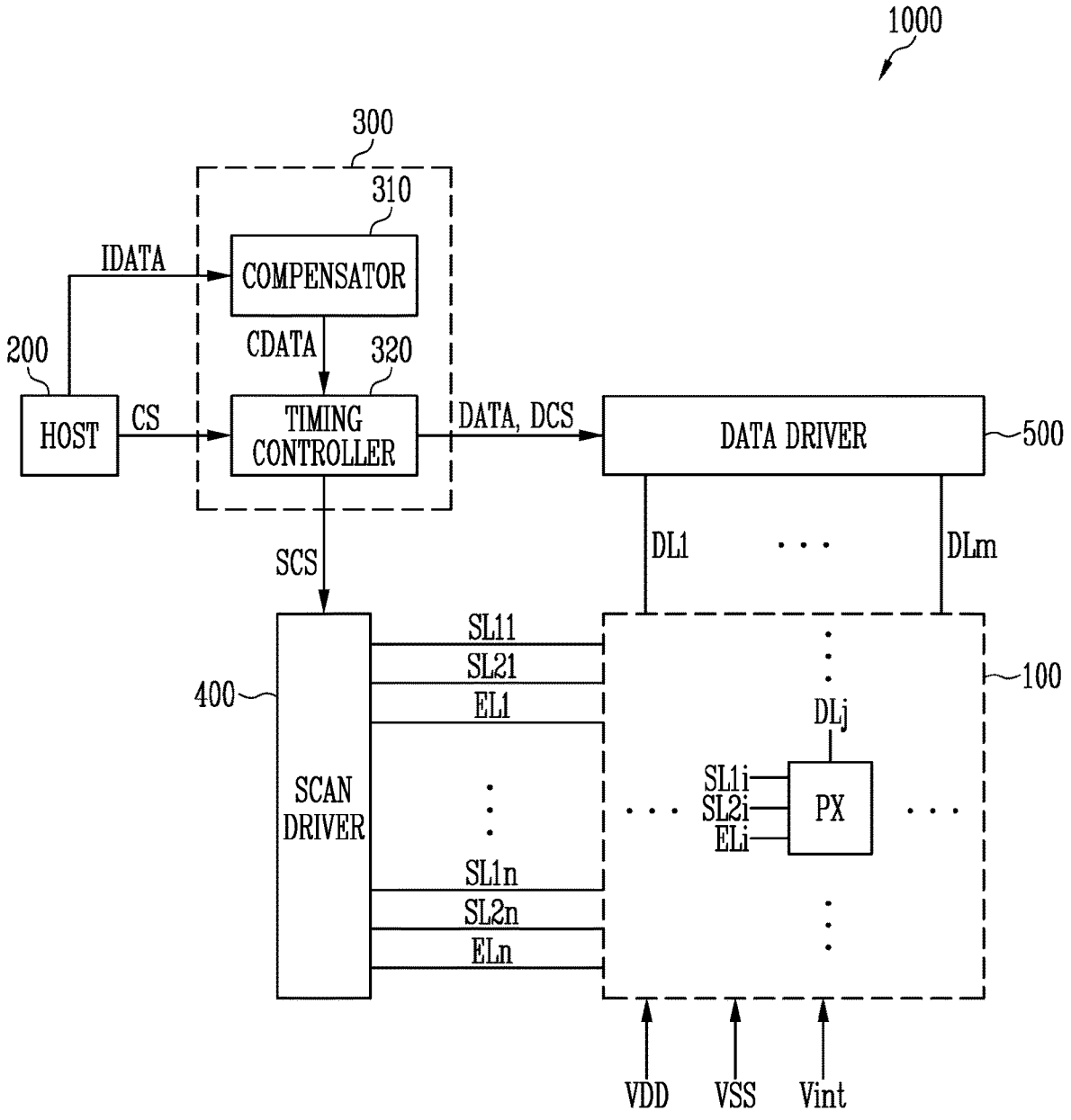
FIG. 1 is a block diagram illustrating a display device in accordance with an embodiment.

Example embodiments are described with reference to the accompanying drawings. The present disclosure may cover various changes applied to the example embodiments.

Like numbers may refer to like elements. In the drawings, dimensions may be exaggerated for clarity. Although the terms "first," "second," etc. may be used to describe various elements, these elements should not be limited by these terms. These terms may be used to distinguish one element from another element. A "first" element discussed below could also be termed a "second" element without departing from the teachings of the present disclosure. The description of an element as a "first" element may not require or imply the presence of a second element or other elements. The terms "first," "second," etc. may be used to differentiate different categories or sets of elements. For conciseness, the terms "first," "second," etc. may represent "first-type (or first-set)," "second-type (or second-set)," etc., respectively.

The singular forms may indicate the plural forms as well, unless the context clearly indicates otherwise.

The terms "includes" and/or "including" may specify the presence of stated items, may do not preclude the presence and/or addition of one or more other items.

The term "connect" or "couple" may mean "electrically connect" or "electrically connected through no intervening transistor." The term "insulate" may mean "electrically insulate" or "electrically isolate." The term "conductive" may mean "electrically conductive." The term "drive" may mean "operate" or "control." The term "compensate" or "compensate for" may mean "adapt," "adjust," or "generate new data for." The term "width" may mean "amount" or "magnitude." The term "a/the signal" may mean "instances of the signal." The term "gamma voltage generator" may mean "gamma voltage provider." The term "gamma voltage compensator" may mean "gamma voltage generator."

Figure 2:
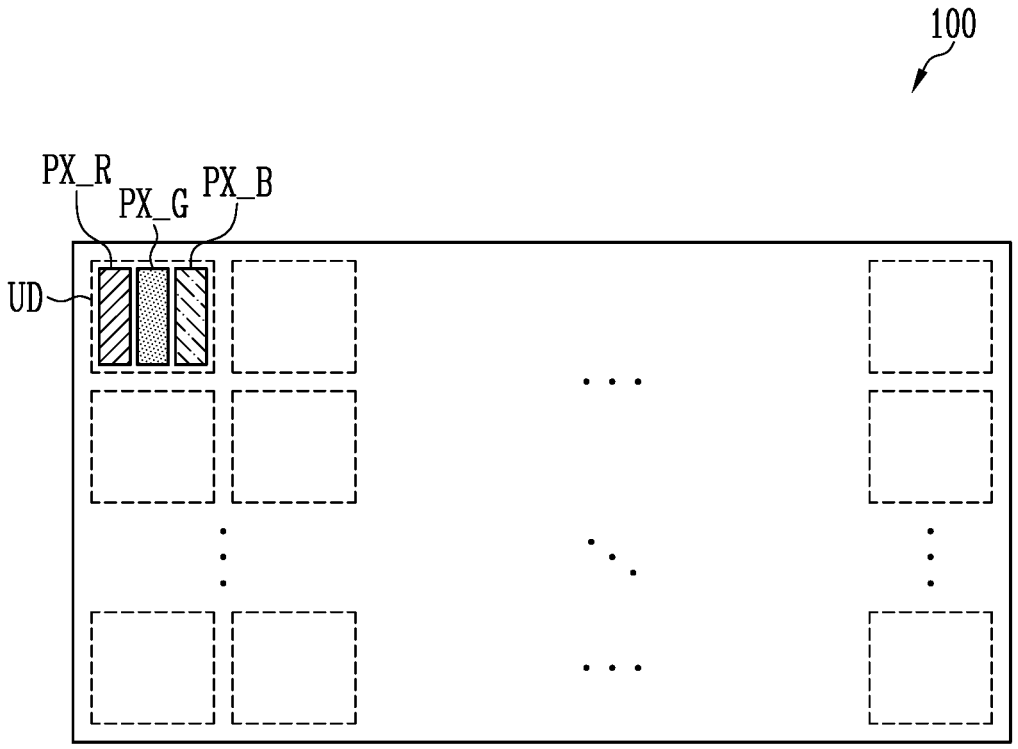
FIG. 2 is a diagram illustrating a display panel included in the display device shown in FIG. 1 according to an embodiment.

FIG. 1 is a block diagram illustrating a display device in accordance with an embodiment. FIG. 2 is a diagram illustrating a display panel included in the display device shown in FIG. 1.

Referring to FIGS. 1 and 2, the display device 1000 may include a display panel 100, a host processor 200, a controller 300, a scan driver 400, and a data driver 500.

The display panel 100 may include scan lines SL11 to SL1*n* and SL21 to SL2*n*, data lines DL1 to DLm, and emission control lines EL1 to ELn, and may include pixels PX coupled to the scan lines SL11 to SL1*n* and SL21 to SL2*n*, the data lines DL1 to DLm, and the emission control lines EL1 to ELn (m and n are integers greater than 1).

Each of the pixels PX may include a driving transistor and a plurality of switching transistors. Each of the pixels PX may emit light with a luminance corresponding to a data signal provided through a corresponding data line in response to a scan signal provided through a corresponding scan line. The pixels PXL may be supplied with a first power supply voltage VDD, a second power supply voltage VSS, and an initialization power source Vint. The first power supply voltage VDD, the second power supply voltage VSS, and the initialization power source Vint may be necessary for an operation of the pixels PX. The first power supply voltage VDD may have a voltage level higher than that of the second power supply voltage VSS. The initialization power source Vint may have a voltage level equal to that of the second power supply voltage VSS.

The display panel 100 may include a plurality of unit dots UD (or pixel group UD). A unit dot UD may be a group of adjacent pixels PX of different single colors. Each unit dot UD may express various colors through combinations of single colors. For example, each unit dot UD may include a first pixel PX_R emitting light of a first color (e.g., red light), a second pixel PX_G emitting light of a second color (e.g., green light), and a third pixel PX_B emitting light of a third color (e.g., blue light). When the display panel 100 has a PENTILE™ structure, each unit dot UD may include one pixel emitting red light, two pixels emitting green light, and one pixel emitting blue light, and adjacent unit dots UD may share one pixel emitting green light. A frame image displayed on the display panel 100 may be expressed in a unit dot UD unit.

The display device 1000 may operate in a first mode (or normal mode) or a second mode (or low power mode). In the first mode, the data signal is supplied to the display panel 100 at a first frequency so as to display a moving image. In the second mode, the data signal is supplied to the display panel 100 at a second frequency so as to display a still image. The second frequency may be lower than the first frequency. For example, the second frequency may be 30 Hz or lower, and the first frequency may be 60 Hz or higher.

When the display panel 100 is driven at a low frequency (or the second frequency), the time for which one frame image is displayed may be relatively lengthened, and a decrease in luminance of the frame image according to elapsed time and a flicker phenomenon due to a repeated decrease in luminance may be visible to a user of the display panel 100. To the user, flicker visibility to the user with respect to green light may be more conspicuous than that with respect to blue light.

The host processor 200 may control overall operations of the display device 1000. For example, the host processor 200 may be/include a system on chip (SoC), and may be an application processor (AP) provided in a mobile device.

The host processor 200 may generate input image data IDATA and a control signal CS, and may provide the input image data IDATA and the control signal CS to the controller 300. The control signal CS may include a vertical synchronization signal, a horizontal synchronization signal, a clock signal, a data enable signal, and the like.

The controller 300 may include a compensator 310 and a timing controller 320.

The compensator 310 may generate compensation image data CDATA (or generated image data CDATA) by compensating for (or adjusting or mapping) the input image data IDAT so as to minimize a flicker phenomenon (which may be visible to the user) according to a frequency at which the display panel 100 is driven.

The compensator 310 may compensate for the input image data IDATA according to the frequency at which the display panel 100 is driven. For example, when the display panel 100 is driven at the second frequency (or low frequency), the compensator 310 may generate the compensation image data CDATA by changing (or decreasing) grayscales of the input image data IDATA.

The compensator 310 may change (or decrease) the grayscales of the input image data IDATA at different ratios for the pixels PX according to different recognition characteristics with respect to colors. For example, when the display panel 100 is driven at the second frequency (or low frequency), flicker visibility to the user with respect to green light is relatively greater than that of the user with respect to blue light, and hence the compensator 310 may decrease a grayscale of input image data IDATA corresponding to the second pixel PX_G (emitting green light) with a width greater than that with which the compensator 310 decreases a grayscale of input image data IDATA corresponding to the third pixel PX_B (emitting blue light). Accordingly, a luminance corresponding to green light of an image displayed on the display panel 100 is decreased with a width greater than that with which a luminance corresponding to blue light of the image displayed on the display panel 100 is decreased, so that the flicker phenomenon visible to the user can be minimized.

The compensator 310 may increase a change amount (e.g., reduction amount) for the grayscales of the input image data IDATA as the driving frequency for the display panel 100 decreases. For example, when the display panel 100 is driven at 20 Hz, a display time for one frame image is longer than that when the display panel 100 is driven at 30 Hz, and hence flicker visibility to the user when the display panel 100 is driven at 20 Hz may be greater than that to the user when the display panel 100 is driven at 30 Hz. To compensate for the difference, the compensator 310 can increase a grayscale reduction amount when the display panel 100 is driven at 20 Hz.

The timing controller 320 may generate a first control signal SCS and a second control signal DCS, corresponding to the control signal CS from the host processor 200. The first control signal SCS may be supplied to the scan driver 400, and the second control signal DCS may be supplied to the data driver 500.

The timing controller 320 may generate image data DATA (or output image data DATA) by converting the compensation image data CDATA supplied from the compensator 310. For example, the timing controller 320 may convert the compensation image data CDATA in an RGB format into the image data DATA in a format suitable for a pixel arrangement of the display panel 100. For example, when each unit dot UD includes the first to third pixels PX_R, PX_G, and PX_B, the timing controller 320 may convert the compensation image data CDATA into image data DATA (or output image data DATA) in the RGB format. As another example, when the display panel 100 has the PENTILE™ structure in which adjacent unit dots UD share one pixel emitting green light, the timing controller 320 may convert the compensation image data CDATA in the RGB format into image data DATA (or output image data DATA) in an RGBG format.

The scan driver 400 may receive the first control signal SCS from the timing controller 320, and supply (instances of) a first scan signal and (instances of) a second scan signal respectively to first scan lines SL11 to SL1*n* and second scan lines SL21 to SL2*n*. The scan driver 400 may supply (instances of) an emission control signal to the emission control lines EL1 to ELn.

For example, the first scan signal may be sequentially supplied to the first scan lines SL11 to SL1*n*, and the second scan signal may be sequentially supplied to the second scan lines SL21 to SL2*n*. The emission control signal may be sequentially supplied to the emission control lines EL1 to ELn.

The scan signal may be set to a gate-on voltage (e.g., a low voltage). A transistor receiving the scan signal may be set to a turn-on state when the scan signal is supplied.

The emission control signal may be set to a gate-off voltage (e.g., a high voltage). A transistor receiving the emission control signal may be turned off when the emission control signal is supplied, and be set to the turn-on state in other cases.

The scan driver 400 may be mounted on a substrate through a thin film process. A single scan driver supplies the first and second scan signals and the emission control signal is illustrated in FIG. 1. The scan driver 400 may include scan drivers, each of which supplies at least one of the first scan signal, the second scan signal, and the emission control signal.

The data driver 500 may receive the second control signal DCS and the image data DATA from the timing controller 320. The data driver 500 may supply a data signal (or data voltage) to the data lines DL1 to DLm, corresponding to the second control signal DCS.

Figure 3:
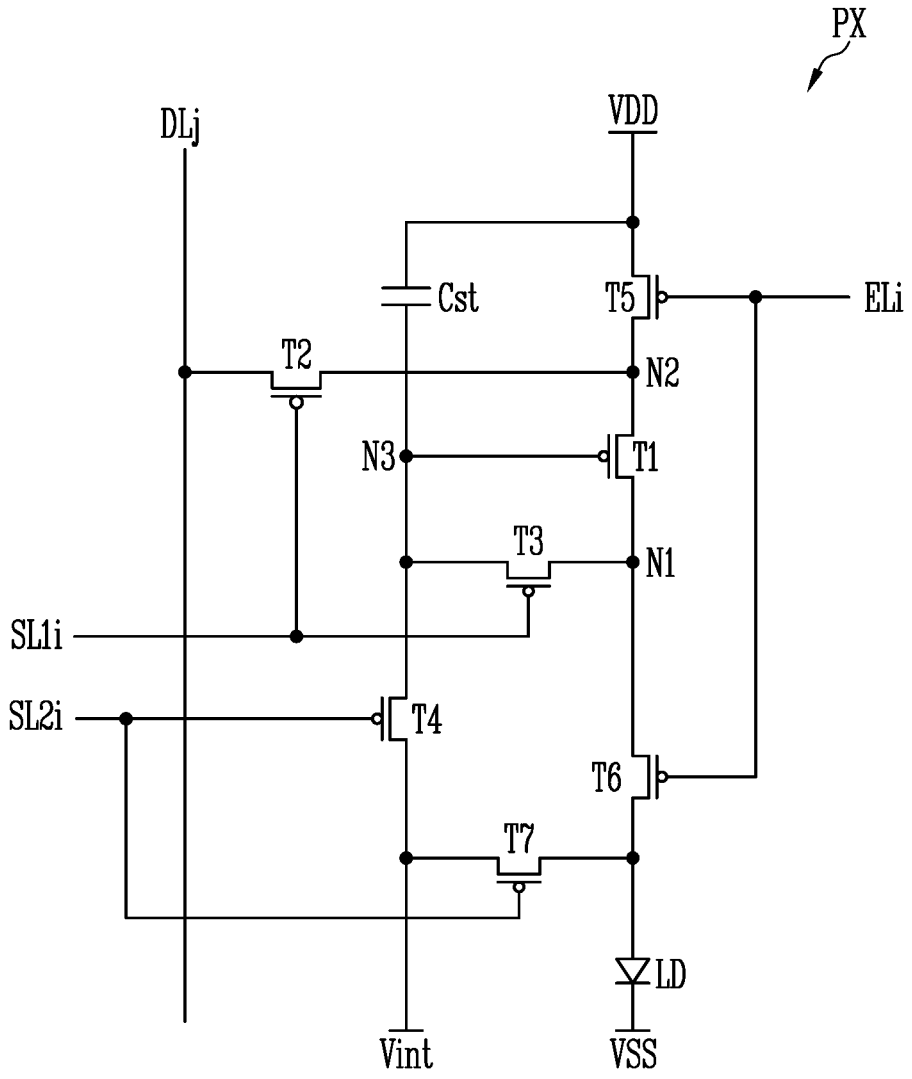
FIG. 3 is a circuit diagram illustrating a pixel included in the display device shown in FIG. 1 according to an embodiment.

FIG. 3 is a circuit diagram illustrating the pixel included in the display device shown in FIG. 1 according to an embodiment.

Referring to FIG. 3, the pixel PX may include first to seventh transistors T1 to T7, a storage capacitor Cst, and a light emitting device LD.

Each of the first to seventh transistors T1 to T7 may be implemented with a P-type transistor. For example, at least some of the first to seventh transistors T1 to T7 may be implemented with an N-type transistor.

A first electrode of the first transistor T1 (driving transistor) may be coupled to a second node N2 or be coupled to a first power supply voltage VDD via the fifth transistor T5. A second electrode of the first transistor T1 may be coupled to a first node N1 or be coupled to an anode of the light emitting device LD via the sixth transistor T6. A gate electrode of the first transistor T1 may be coupled to a third node N3. The first transistor T1 may control an amount of current flowing from the first power supply voltage VDD to a second power supply voltage VSS via the light emitting device LD, corresponding to a voltage of the third node N3.

The second transistor T2 may be coupled between a data line DLj and the second node N2. A gate electrode of the second transistor T2 may be coupled to a first scan line SL1*i*. The second transistor T2 may be turned on when a first scan signal is supplied to the first scan line SL1*i*, to allow the data line DLj and the first electrode of the first transistor T1 to be electrically coupled to each other.

The third transistor T3 may be coupled between the first node N1 and the third node N3. A gate electrode of the third transistor T3 may be coupled to the first scan line SL1*i*. The third transistor T3 may be turned on when the first scan signal is supplied to the first scan line SL1*i*, to allow the first node N1 and the third node N3 to be electrically coupled to each other. Therefore, the first transistor T1 may be diode-coupled when the third transistor T3 is turned on.

The storage capacitor Cst may be coupled between the first power supply voltage VDD and the third node N3. The storage capacitor Cst may store a voltage corresponding to a data signal and a threshold voltage of the first transistor T1.

The fourth transistor T4 may be coupled between the third node N3 and an initialization power supply voltage Vint. A gate electrode of the fourth transistor T4 may be coupled to a second scan line SL2*i*. The fourth transistor T4 may be turned on when a second scan signal is supplied to the second scan line SL2*i*, to supply the initialization power supply voltage Vint to the third node N3. The initialization power supply voltage Vint may be set to have a voltage level lower than that of the data signal.

The fifth transistor T5 may be coupled between the first power supply voltage VDD and the second node N2. A gate electrode of the fifth transistor T5 may be coupled to an emission control line ELi. The fifth transistor T5 may be turned off when an emission control signal is supplied to the emission control line ELi, and be turned on in other cases.

The sixth transistor T6 may be coupled between the first node N1 and the light emitting device LD. A gate electrode of the sixth transistor T6 may be coupled to the emission control line ELL The sixth transistor T6 may be turned off when the emission control signal is supplied to the emission control line ELi, and be turned on in other cases.

The seventh transistor T7 may be coupled between the initialization power supply voltage Vint and the anode of the light emitting device LD. A gate electrode of the seventh transistor T7 may be coupled to the second scan line SL2*i*. The seventh transistor T7 may be turned on when the second scan signal is supplied to the second scan line SL2*i*, to supply the initialization power supply voltage Vint to the anode of the light emitting device LD.

The anode of the light emitting device LD may be coupled to the first transistor T1 via the sixth transistor T6, and a cathode of the light emitting device LD may be coupled to the second power supply voltage VSS. The light emitting device LD may generate light with a predetermined luminance, corresponding to a current supplied from the first transistor T1. The first power supply voltage VDD may be set to have a voltage level higher than that of the second power supply voltage VSS such that the current flows through the light emitting device LD.

The light emitting device LD may be selected as an organic light emitting diode. The light emitting device LD may be selected as an inorganic light emitting diode such as a micro LED (light emitting diode) or a quantum dot light emitting diode. The light emitting device LD may be an element made of a combination of an organic material and an inorganic material. In FIG. 3, it is illustrated that the pixel PX includes a single light emitting device LD. However, in another embodiment, the pixel PX may include a plurality of light emitting devices, and the plurality of light emitting devices may be coupled in parallel to each other, be coupled in series to each other, or be coupled in series/parallel to each other.

Figure 4:
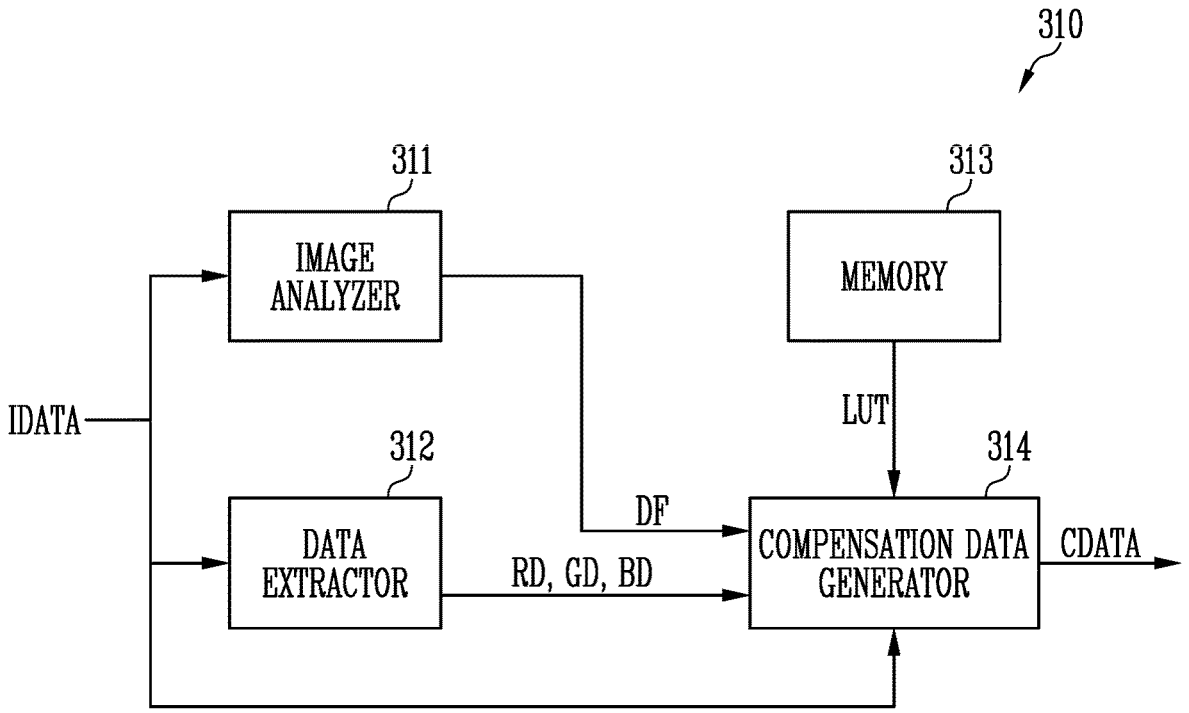
FIG. 4 is a block diagram illustrating a compensator included in the display device shown in FIG. 1 according to an embodiment.

FIG. 4 is a block diagram illustrating the compensator included in the display device shown in FIG. 1 according to an embodiment. FIGS. 5 to 10B are diagrams illustrating at least one lookup table stored in the compensator shown in FIG. 4 according to one or more embodiments. For convenience of description, in the description associated with FIGS. 4 to 10B, each unit dot UD shown in FIG. 2 includes a first pixel PX_R emitting red light, a second pixel PX_G emitting green light, and a third pixel PX_B emitting blue light. One unit dot UD is described as long as an example.

Referring to FIGS. 1, 2, and 4, the compensator 310 may include an image analyzer 311, a data extractor 312, a memory 313, and a compensation data generator 314.

The image analyzer 311 may receive input image data IDATA, and may generate frequency data DF by analyzing a frequency at which the display panel 100 is driven, based on the input image data IDATA. For example, the image analyzer 311 may analyze the frequency at which the display panel 100 is driven by counting a number of times the input image data IDATA is supplied from the host processor 200 for a unit time (e.g., one second). As an example, when the input image data IDATA is supplied 60 times from the host processor 200 for one second, the image analyzer 311 may generate the frequency data DF as 60 Hz. When the input image data IDATA is supplied 30 times from the host processor 200 for one second, the image analyzer 311 may generate the frequency data DF as 20 Hz.

The image analyzer 311 may receive the control signal CS from the host processor 200, and may generate the frequency data DF by counting a vertical blank period for a unit time, using the vertical synchronization signal included in the control signal CS, and analyzing a driving frequency of the display panel 100.

The data extractor 312 may receive input image data IDATA, and may extract first to third grayscales RD, GD, and BD of the input image data IDATA corresponding to one unit dot UD. The first grayscale may correspond to a red grayscale, the second grayscale may correspond to a green grayscale, and the third grayscale may correspond to a blue grayscale. That is, the first grayscale RD may correspond to the first pixel PX_R, the second grayscale GD may correspond to the second pixel PX_G, and the third grayscale BD may correspond to the third pixel PX_B.

The memory 313 may be/include a hardware memory device and store a predetermined lookup table LUT. The lookup table LUT may include information on values to which the first to third grayscales are to be changed (or decreased), corresponding to a frequency at which the display panel 100 is driven. The lookup table LUT may be generated by analyzing the driving frequency of the display panel 100 and a change in luminance waveform according to time for each color, or be experimentally determined based on different recognition characteristics of a user with respect to colors according to the driving frequency of the display panel 100. The lookup table LUT is further described with reference to FIGS. 5 to 10B.

The compensation data generator 314 may determine a driving frequency of the display panel 100, based on the frequency data DF, and generate compensation data CDATA by compensating for the input image data IDATA, based on the driving frequency, the first to third grayscales RD, GD, and BD, and the lookup table LUT.

In an embodiment, in the second mode, when it is determined that the display panel 100 is driven at the second frequency (or low frequency), based on the frequency data DF, the compensation data generator 314 may generate the compensation data CDATA by changing the first to third grayscales, based on the lookup table LUT. For example, the compensation data generator 314 may generate the compensation data CDATA by decreasing the first to third grayscales (or generating reduced grayscales for replacing the first to third grayscales).

The compensation data generator 314 may generate the compensation image data CDATA by changing (or decreasing) the first to third grayscales RD, GD, and BD at different ratios corresponding to different flicker recognition characteristics of the user with respect to different colors. For example, flicker visibility to the user with respect to the green light may be relatively greater than that of the user with respect to the red light. Therefore, the compensation data generator 314 may generate the compensation image data CDATA by setting a grayscale decrease of the second grayscale GD to be greater than that of grayscale decrease of the first grayscale RD in the second mode. As another example, the flicker visibility to the user with respect to the red light may be relatively greater than that of the user with respect to the blue light. Therefore, the compensation data generator 314 may generate the compensation image data CDATA by setting a grayscale decrease of the first grayscale RD to be greater than that of grayscale decrease of the third grayscale BD in the second mode. Accordingly, when the first to third grayscales RD, GD, and BD included in the input image data IDATA are the same, luminances of the red light, the green light, and the blue light emitted from one unit dot UD may be different from one another, based on the compensation image data CDATA generated by the compensation data generator 314. That is, the first to third pixels PX_R, PX_G, and PX_B included in the one unit dot UD may emit lights with different luminances. Accordingly, a flicker phenomenon visible to the user can be minimized.

The compensation data generator 314 may increase the grayscale decrease amounts of the first to third grayscales RD, GD, and BD as the driving frequency of the display panel 100 decreases.

Even when the display panel 100 is driven at a low frequency, the compensation data generator 314 may not change the first to third grayscales RD, GD, and BD when it is determined that the flicker phenomenon is not conspicuous or visible to the user with respect to an image displayed in the unit dot UD, based on the first to third grayscales RD, GD, and BD. For example, when the luminance corresponding to each of the first to third grayscales RD, GD, and BD is relatively low, the flicker phenomenon may not be conspicuous or visible to the user even when the display panel 100 is driven at the low frequency. Therefore, the compensation data generator 314 may determine, based on the lookup table LUT, that any flicker is not visible to the user with respect to an image displayed based on the first to third grayscales RD, GD, and BD. Accordingly, the compensation data generator 314 may not change the first to third grayscales RD, GD, and BD.

The compensation data generator 314 may generate the compensation image data CDATA by changing some, but not all, of the first to third grayscales RD, GD, and BD. The compensation data generator 314 may generate the compensation image data by determining flicker visibilities to the user with respect to the red light, the green light, and the blue light of an image displayed in the unit dot UD, based on the first to third grayscales RD, GD, and BD, and decreasing a grayscale with respect to only one or more colors with significant flicker visibility. As an example, the compensation data generator 314 may generate the compensation image data CDATA by changing only the second grayscale GD and not changing the first and third grayscales RD and BD.

The compensator 310 may determine whether the first to third grayscales RD, GD, and BD are to be changed, based on the lookup table LUT stored in the memory 313. The lookup table LUT is described with reference to FIGS. 5 to 10B. In related description, the display panel 100 is driven at 30 Hz in the second mode.

Figure 5:
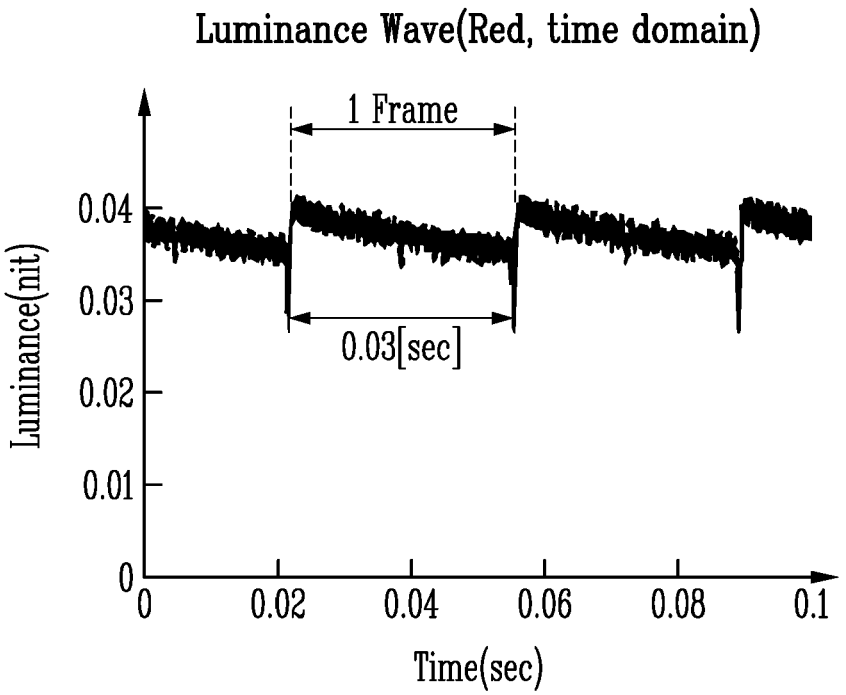
FIG. 5, FIG. 6, FIG. 7, FIG. 8A, FIG. 8B, FIG. 9A, FIG. 9B, FIG. 10A, and FIG. 10B are diagrams illustrating one or more lookup tables stored in the compensator shown in FIG. 4 according to one or more embodiments.
Figure 6:
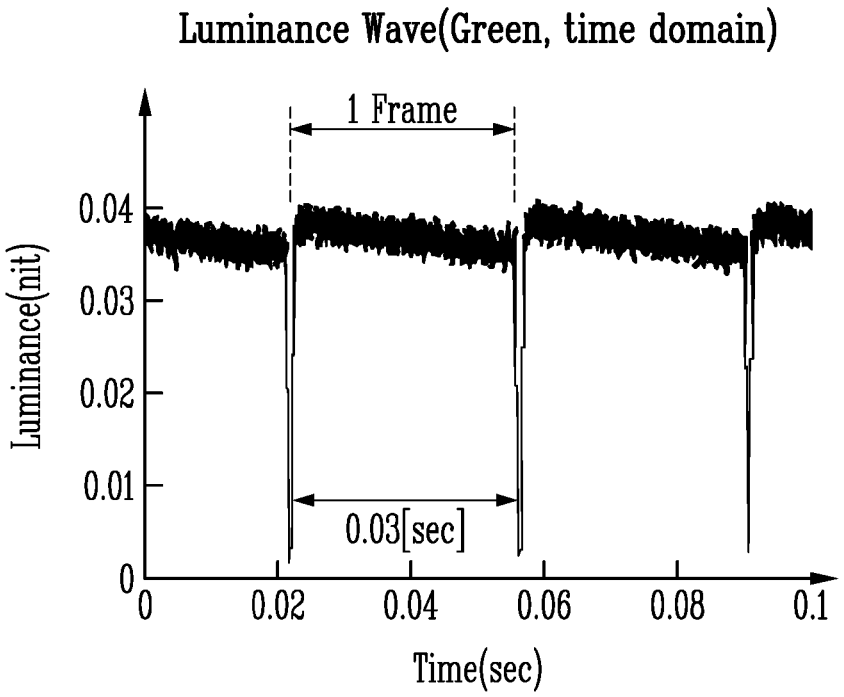
Figure 7:
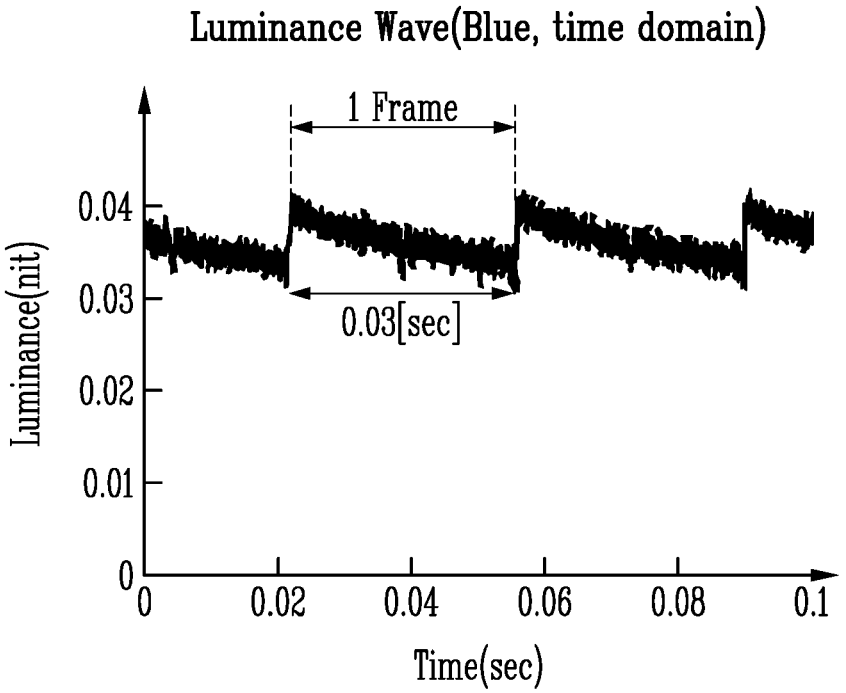

Referring to FIGS. 5 to 7, luminance degradation according to elapsed time in one frame (1 Frame) may be most significant in the green light. The flicker phenomenon recognized by the user may become more serious as the luminance degradation becomes more significant according to the elapsed time. The flicker recognition characteristic of the user may become serious in an order of the blue light, the red light, and the green light.

Figure 8B:
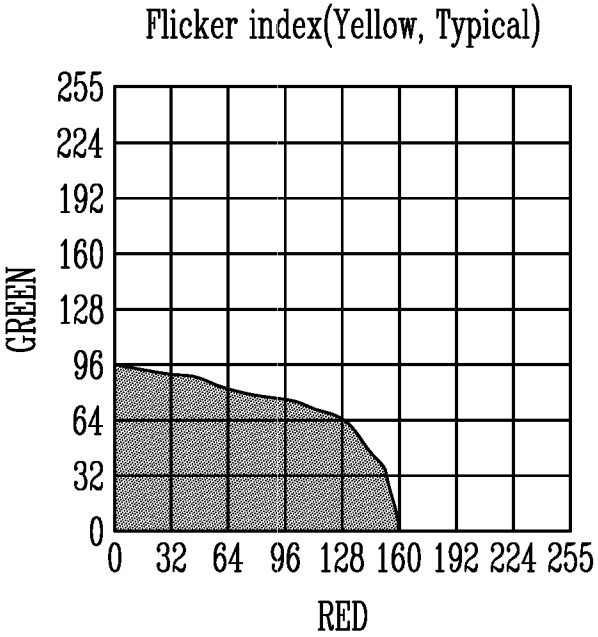
Figure 8A:
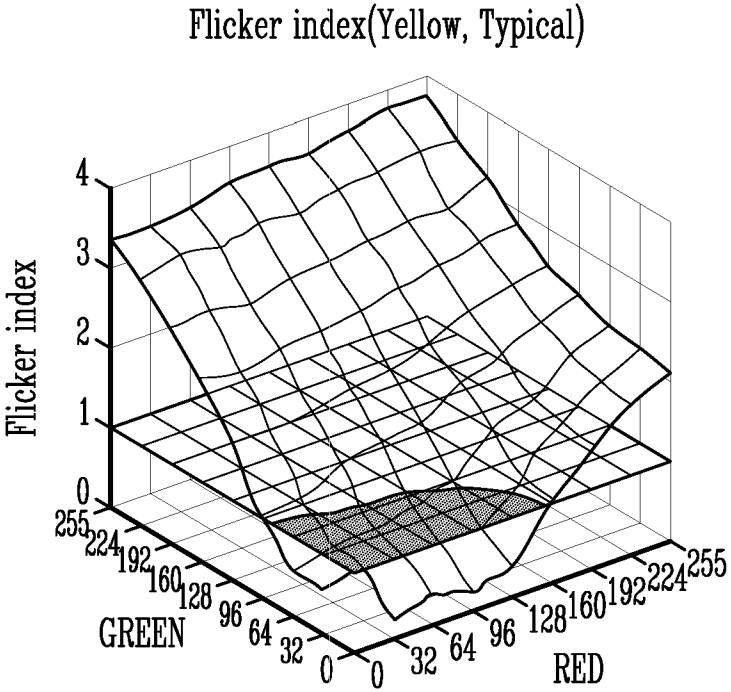

Flicker indices respectively corresponding to grayscales of the red light, the green light, and the blue light are shown in FIGS. 8A to 10B. In FIGS. 8A, 9A, and 10A, a plane with the flicker index 1 may mean a reference plane corresponding to a flicker index threshold. When the flicker index is 1 or less, the flicker phenomenon may not be recognized by the user. When the flicker index exceeds 1, the flicker phenomenon may be recognized by the user.

Figure 9B:
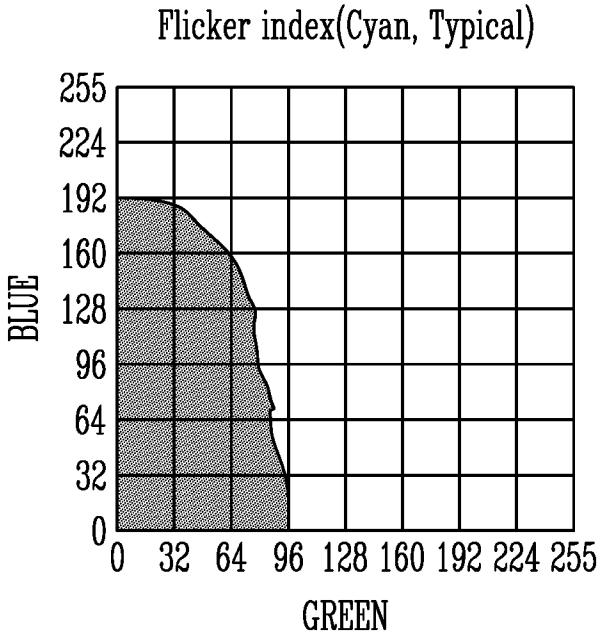
Figure 9A:
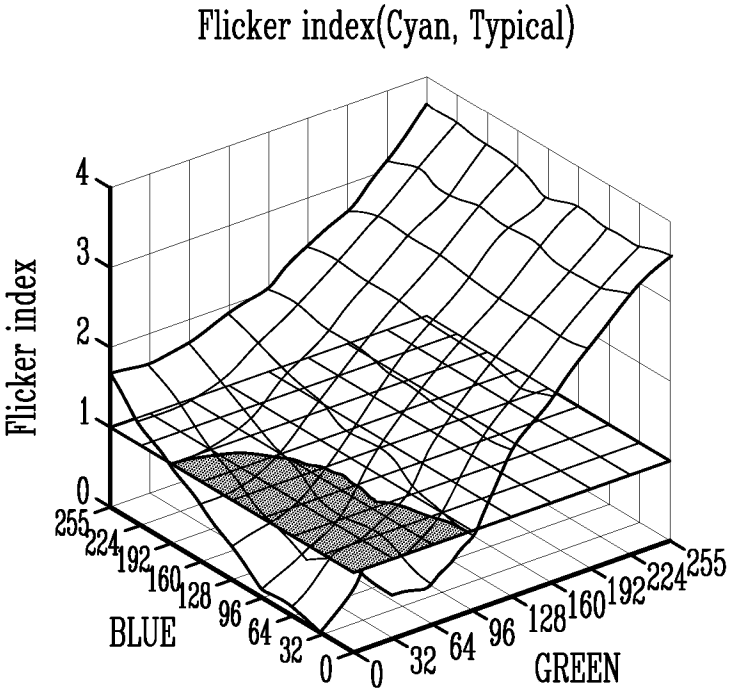
Figure 10B:
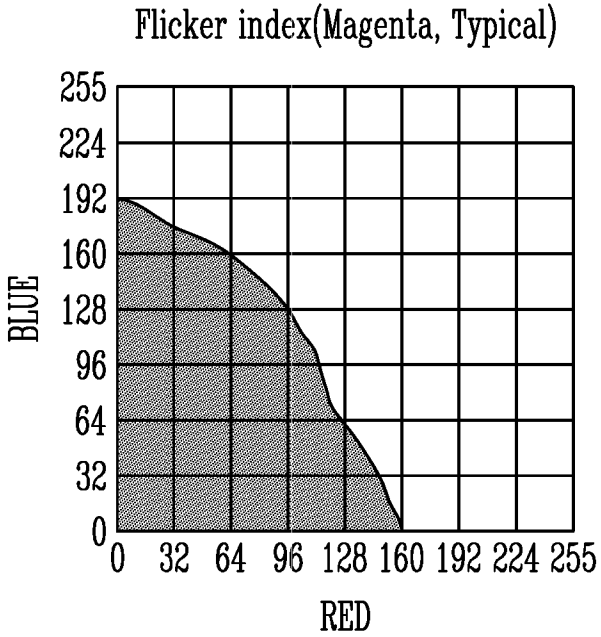
Figure 10A:
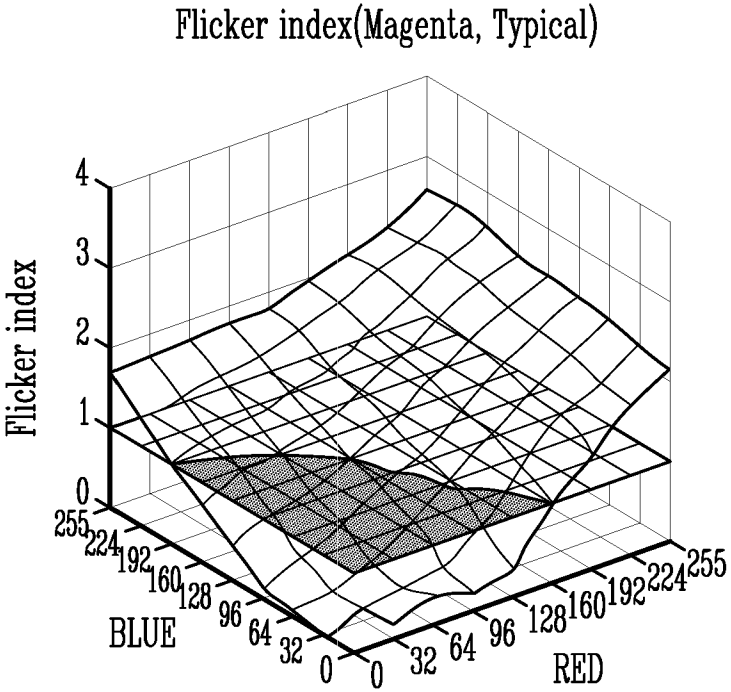

Referring to FIGS. 8B, 9B, and 10B, when the display panel 100 is driven at 30 Hz, the flicker phenomenon may be recognized by the user when the grayscale of the red light exceeds about grayscale 160 (or when the first grayscale RD exceeds the grayscale 160). The flicker phenomenon may be recognized by the user when the grayscale of the green light exceeds about grayscale 96 (or when the second grayscale GD exceeds the grayscale 96). The flicker phenomenon may be recognized by the user when the grayscale of the blue light exceeds about grayscale 192 (or when the third grayscale BD exceeds the grayscale 192). The flicker recognition characteristic of the user may be relatively significant in the green light.

In the lookup table LUT, in order for the user not to recognize any significant flicker, the grayscale of the red light may be set 160 or less, the grayscale of the green light may be set 96 or less, and the grayscale of the blue light may be set 192 or less.

With respect to the red light, grayscale 0 and the grayscale 160 may be stored in the lookup table LUT, respectively corresponding to when the first grayscale RD included in the input image data IDATA is the grayscale 0 and when the first grayscale RD is grayscale 255. Grayscales stored in the lookup table LUT may linearly increase at the same interval between the grayscale 0 and the grayscale 160 as approaching grayscale 254 (or 255) from grayscale 1 (or 0), corresponding to when the first grayscale RD is in a range of the grayscale 1 (or 0) to the grayscale 254 (or 255).

With respect to the green light, the grayscale 0 and the grayscale 96 may be stored in the lookup table LUT, respectively corresponding to when the second grayscale GD included in the input image data IDATA is the grayscale 0 and when the second grayscale GD is grayscale 255. Grayscales stored in the lookup table LUT may linearly increase at the same interval between the grayscale 0 and the grayscale 96 as approaching the grayscale 254 (or 255) from the grayscale 1 (or 0), corresponding to when the second grayscale GD is in a range of the grayscale 1 (or 0) to the grayscale 254 (or 255).

With respect to the blue light, the grayscale 0 and the grayscale 192 may be stored in the lookup table LUT, respectively corresponding to when the third grayscale BD included in the input image data IDATA is the grayscale 0 and when the third grayscale BD is grayscale 255. Grayscales stored in the lookup table LUT may linearly increase at the same interval between the grayscale 0 and the grayscale 192 as approaching the grayscale 254 (or 255) from the grayscale 1 (or 0), corresponding to when the third grayscale BD is in a range of the grayscale 1 (or 0) to the grayscale 254 (or 255).

The compensator 310 may generate the compensation image data CDATA by changing (or decreasing) the first to third grayscales RD, GD, and BD at different ratios with respect to the red light, the green light, and the blue light, based on the lookup table LUT.

Grayscales corresponding to driving frequencies of 20 Hz, 15 Hz, and the like in addition to the driving frequency of 30 Hz may be stored in the lookup table LUT.

The display device 1000 can change grayscales of the input image data IDATA at different ratios with respect to the red light, the green light, and the blue light, according to different flicker recognition characteristics of the user with respect to different colors. Accordingly, the flicker phenomenon can be effectively compensated.

Figure 11:
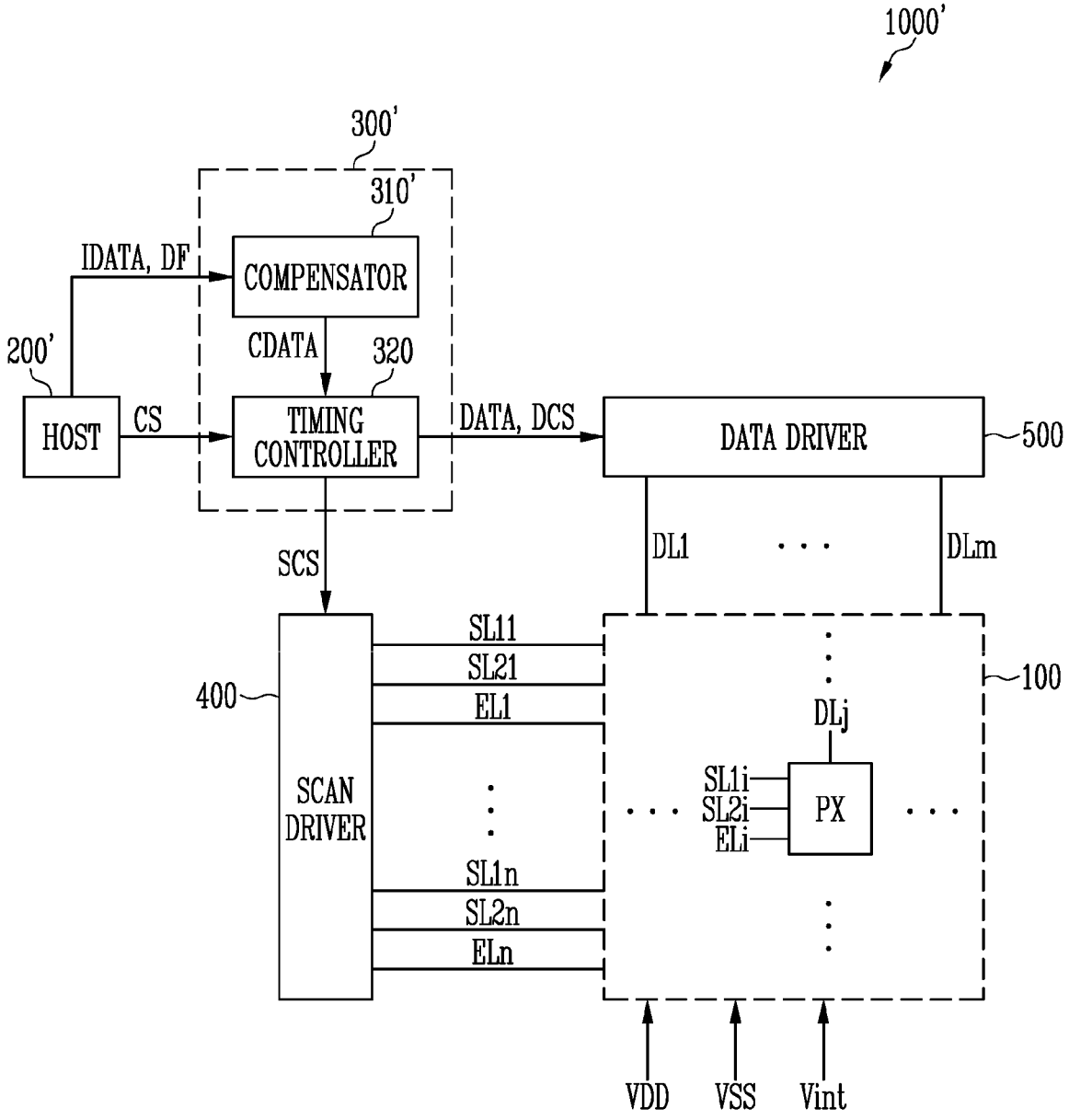
FIG. 11 is a block diagram illustrating a display device in accordance with an embodiment.
Figure 12:
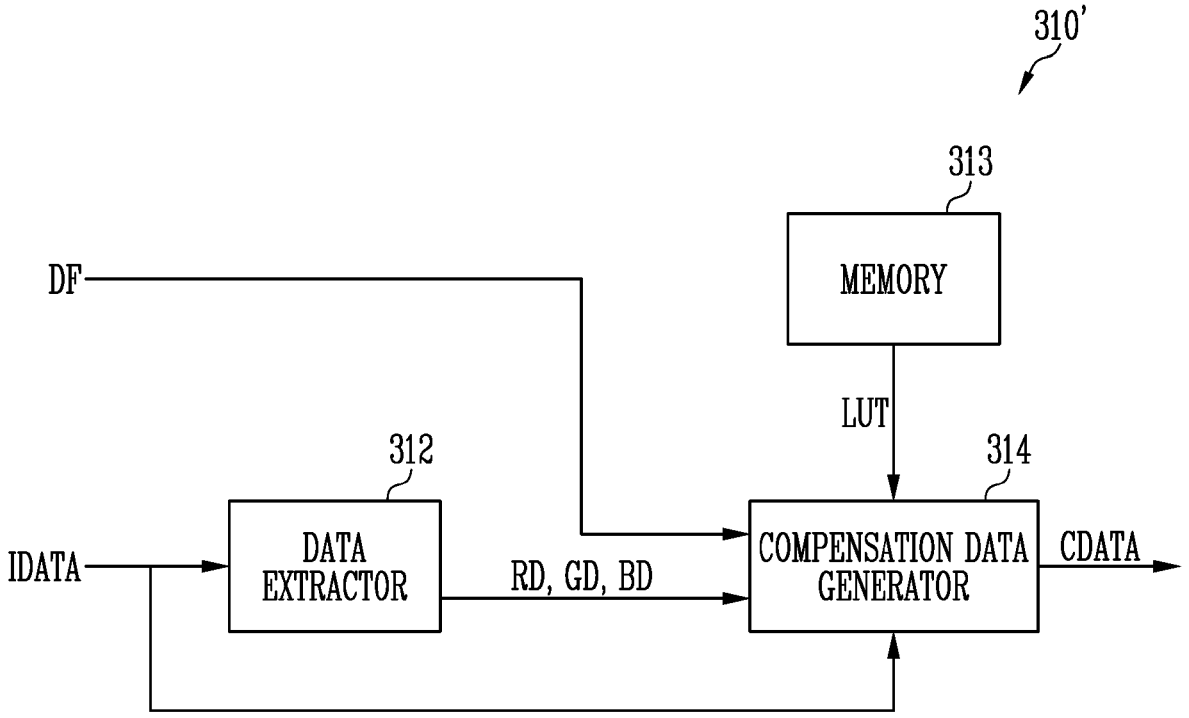
FIG. 12 is a block diagram illustrating a compensator included in the display device shown in FIG. 11 according to an embodiment.

FIG. 11 is a block diagram illustrating a display device in accordance with an embodiment. FIG. 12 is a block diagram illustrating a compensator included in the display device shown in FIG. 11 according to an embodiment. In FIGS. 11 and 12, description associated with elements and/or features described with reference to FIGS. 1 to 10B may not be repeated.

Referring to FIGS. 11 and 12, a display device 1000' may include a display panel 100, a host processor 200, a controller 300', a scan driver 400, and a data driver 500. The controller 300' may include a compensator 310, which may include a data extractor 312, a memory 313, and a compensation data generator 314.

The host processor 200' may generate frequency data DF corresponding to a frequency at which the display panel 100 is driven, and may supply the frequency data DF to the controller 300'.

The compensation data generator 314 may generate compensation image data CDATA by determining a driving frequency of the display panel 100, based on the frequency data DF supplied from the host processor 300'.

Figure 13:
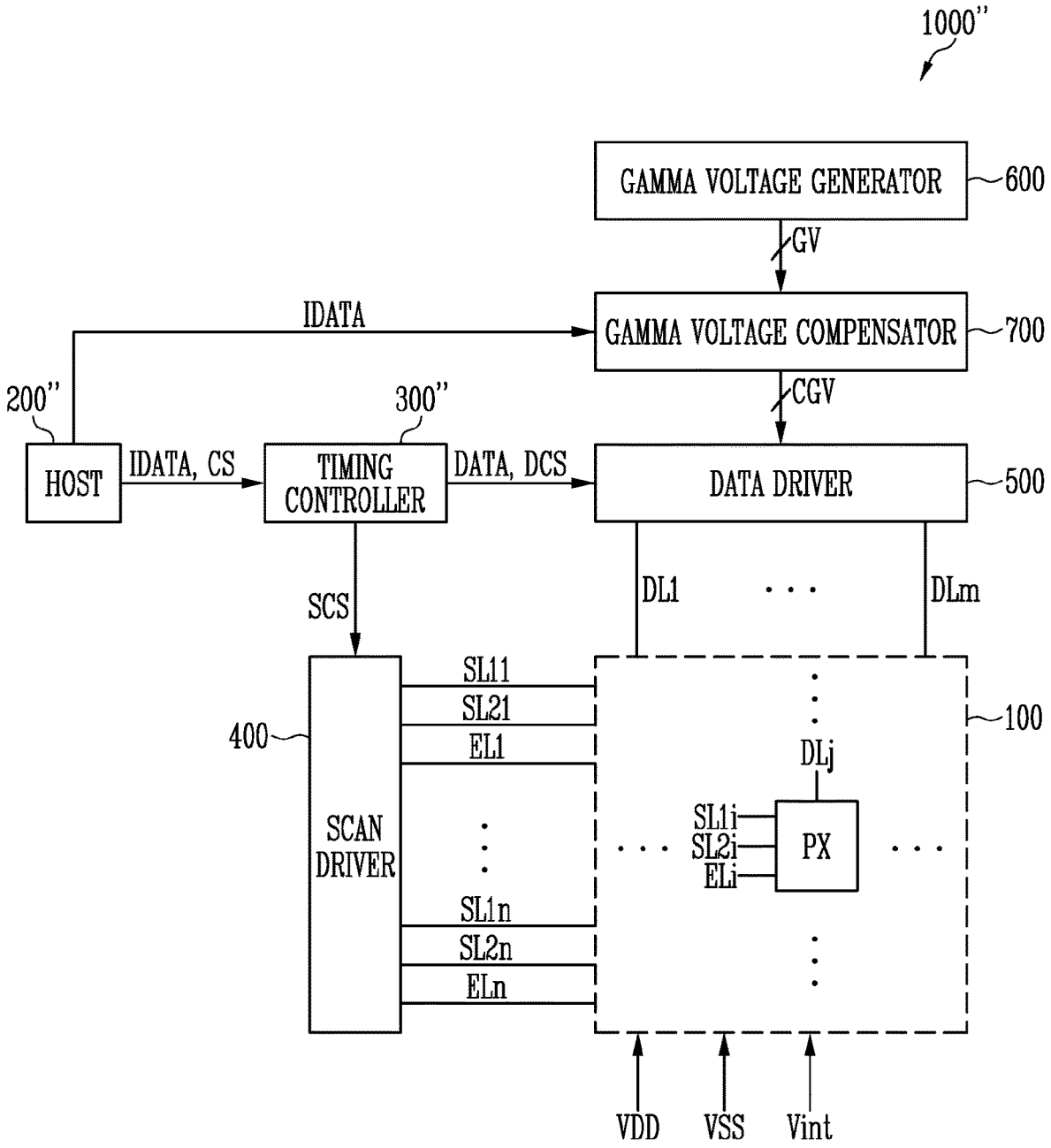
FIG. 13 is a block diagram illustrating a display device in accordance with an embodiment.
Figure 14:
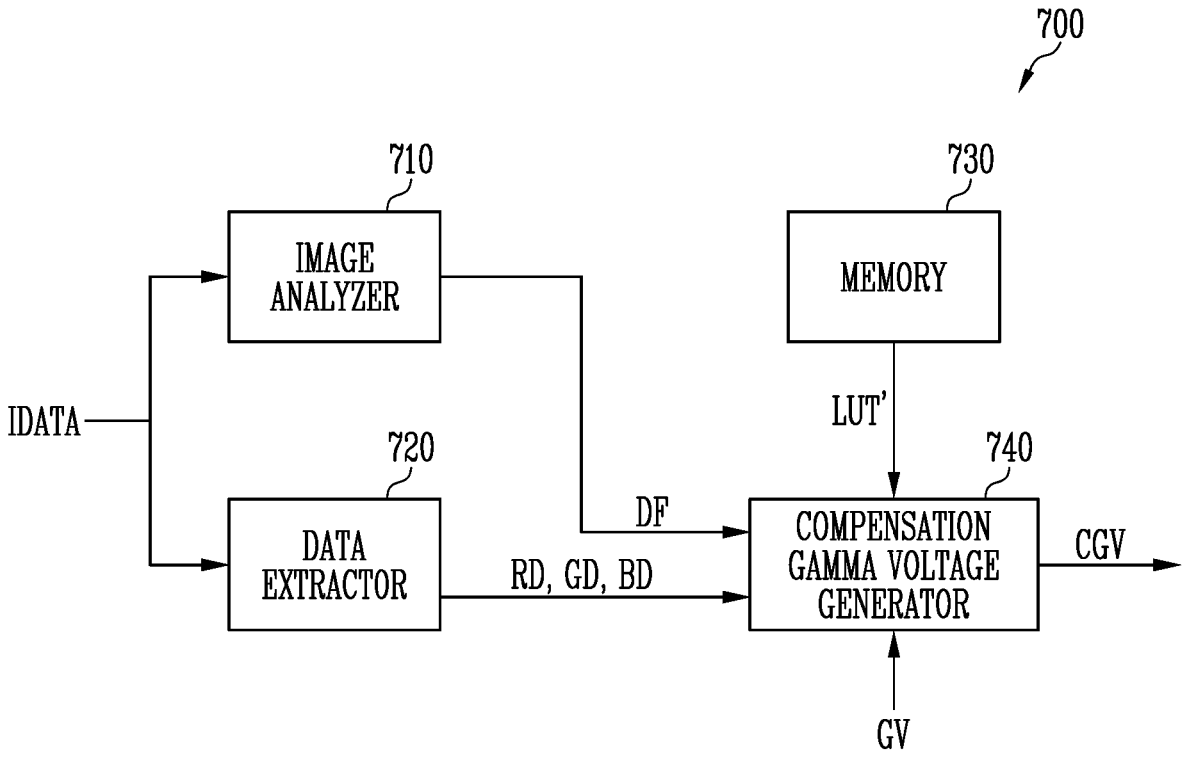
FIG. 14 is a block diagram illustrating a gamma voltage compensator included in the display device shown in 13 according to an embodiment.

FIG. 13 is a block diagram illustrating a display device in accordance with an embodiment. FIG. 14 is a block diagram illustrating a gamma voltage compensator included in the display device shown in 13 according to an embodiment. In FIGS. 13 and 14, description associated with elements and/or features described with reference to FIGS. 1 to 10B may not be repeated.

Referring to FIGS. 13 and 14, a display device 1000" may include a display panel 100, a host processor 200", a controller 300" (or timing controller), a scan driver 400, a data driver 500, a gamma voltage generator 600, and a gamma voltage compensator 700.

The host processor 200" may supply input image data IDATA to the gamma voltage compensator 700.

The gamma voltage generator 600 may generate at least one gamma voltage GV and provide the at least one gamma voltage GV to the gamma voltage compensator 700. The at least one gamma voltage GV may correspond to a set of data signals (or data voltages) for grayscales of an image, which correspond to a predetermined gamma curve. A number of potential levels of a gamma voltage GV may be equal to that of grayscale levels which can be displayed on the display panel 100. For example, when the display panel 100 displays 256 grayscale levels, a gamma voltage GV may include 256 potential levels corresponding to the respective grayscale levels.

The gamma voltage compensator 700 may generate at least one compensation gamma voltage CGV (or generated gamma voltage CGV) by analyzing a frequency at which the display panel 100 is driven, based on the input image data IDATA supplied from the host processor 200", extracting first to third grayscales RD, GD, and BD included in the input image data IDATA, and compensating for the gamma voltage GV such that a flicker phenomenon is not conspicuous to a user with respect to an image displayed on the display panel 100. For example, the gamma voltage compensator 700 may generate a compensation/adjusted gamma voltage CGV by changing (or decreasing) a gamma voltage GV corresponding to each of the first to third grayscales RD, GD, and BD. The gamma voltage compensator 700 may supply the compensation/adjusted gamma voltage CGV to the data driver 500.

A configuration and a function of the gamma voltage compensator 700 included in the display device 1000" shown in FIG. 13 are substantially identical or similar to those of the compensator 310 included in the display device 1000 shown in FIG. 1, except that at least one gamma voltage, instead of changing grayscales of the input image data IDATA, is changed. In the second mode in which the display panel 100 is driven at the second frequency (or low frequency), the gamma voltage compensator 700 may change (or decrease) gamma voltages GV respectively corresponding to the first to third grayscales RD, GD, and BD at different ratios corresponding to flicker visibility characteristics of a user for different colors, and may increase a gamma voltages GV change amount (or reduction amount) as the driving frequency of the display panel 100 decreases.

Further referring to FIG. 14, the gamma voltage compensator 700 may include an image analyzer 710, a data extractor 720, a memory 730 (which may include a hardware circuit with one or more semiconductor components), and a compensation gamma voltage generator 740. The image analyzer 710 and the data extractor 720 may be substantially identical to or analogous to the image analyzer 311 and the data extractor 312 included in the compensator 310 shown in FIG. 4.

The memory 730 may store a predetermined lookup table LUT'. The lookup table LUT' may include information on values to which the gamma voltage GV are to be changed (or decreased) such that the flicker phenomenon is not conspicuous to the user, corresponding to a frequency at which the display panel 100 is driven. A configuration of the lookup table may be substantially identical or similar the configuration of the lookup table LUT described with reference to FIGS. 4 to 10B.

The compensation gamma voltage generator 740 may determine a driving frequency of the display panel 100, based on the frequency data DF, and may generate the compensation gamma voltage CGV by compensating for gamma voltages GV respectively corresponding to the first to third grayscales RD, GD, and BD, based on the first to third grayscales RD, GD, and BD, the driving frequency, and the lookup table LUT'.

In accordance with embodiments, a display device includes a controller which changes grayscales of input image data at different ratios according to colors of pixels, based on different flicker recognition characteristics of a user with respect to different colors. Advantageously, a flicker phenomenon can be effectively minimized.

Example embodiments have been described. Features, characteristics, and/or elements described in connection with a particular embodiment may be used singly or in combination with features, characteristics, and/or elements described in connection with other embodiments unless otherwise specifically indicated. Various changes in form and details may be made to the example embodiments without departing from the scope set forth in the following claims.

What is claimed is:

1. A display device comprising:

a display panel including a first pixel emitting light of a first color, a second pixel emitting light of a second color, and a third pixel emitting light of a third color;

data lines electrically connected to the display panel;

a controller configured to generate generated image data based on input image data and a frequency at which the display panel is driven, and configured to generate output image data based on the generated image data; and a data driver electrically connected to the controller, configured to generate data signals based on the output image data, and configured to supply the data signals to the display panel through the data lines, wherein the input image data includes a first grayscale for the first pixel, a second grayscale for the second pixel, and a third grayscale for the third pixel, wherein the generated image data includes a first generated grayscale for the first pixel, a second generated grayscale for the second pixel, and a third generated grayscale for the third pixel, and wherein a ratio of the first generated grayscale to the first grayscale, a ratio of the second generated grayscale to the second grayscale, and the third generated grayscale to the third grayscale are different from one another.

2. The display device of claim 1, wherein the display panel operates in one of a first mode in which the data signals are supplied at a first frequency and a second mode in which the data signals are supplied at a second frequency lower than the first frequency, and wherein the controller generates the first generated grayscale, the second generated grayscale, and the third grayscale in the second mode.

3. The display device of claim 2, wherein the first generated grayscale, the second generated grayscale, and the third grayscale are respectively less than the first grayscale, the second grayscale, and the third grayscale in the second mode.

4. The display device of claim 3, wherein a difference between the first grayscale and the first generated grayscale increases as a magnitude of the second frequency decreases in the second mode.

5. The display device of claim 1, wherein when the first grayscale, the second grayscale, and the third grayscale included in the input image data are equal to one another, luminance of the first pixel, luminance of the second pixel, and luminance of the third pixel are different from one another according to the generated image data.

6. The display device of claim 3, wherein the first pixel emits red light, the second pixel emits green light, and the third pixel emits blue light.

7. The display device of claim 6, wherein in the second mode, a difference between the first generated grayscale and the first grayscale is greater than that between the third grayscale and the third generated grayscale, and a difference between the second grayscale and the second generated grayscale is greater than that between the first grayscale and the first generated grayscale.

8. The display device of claim 1, wherein the controller includes:

an image analyzer configured to generate frequency data by analyzing the frequency at which the display panel is driven, based on the input image data; and a data extractor configured to extract the first grayscale, the second grayscale, and the third grayscales included in the input image data.

9. The display device of claim 8, wherein the controller further includes a generated data generator configured to generate the generated image data, based on the frequency data, the first grayscale, the second grayscale, and the third grayscale.

10. The display device of claim 9, wherein the controller further includes a memory storing at least one lookup table, and wherein the generated data generator generates the generated image data by changing the first grayscale, the second grayscale, the third grayscale base on the lookup table.

11. The display device of claim 1, further comprising a host processor configured to supply the input image data and frequency data to the controller, the frequency data corresponding to the frequency at which the display panel is driven, wherein the controller includes:

a data extractor configured to extract the first grayscale, the second grayscale, and the third grayscale included in the input image data; and a generated data generator configured to generate the generated image data, based on the frequency data, the first grayscale, the second grayscale, and the third grayscale.

12. A display device comprising:

a display panel including a first pixel emitting light of a first color, a second pixel emitting light of a second color, and a third pixel emitting light of a third color;

data lines electrically connected to the display panel;

a controller configured to generate output image data based on input image data;

a gamma voltage provider configured to provide provided gamma voltages;

a gamma voltage generator configured to generate generated gamma voltages based on the provided gamma voltages according to a frequency at which the display panel is driven; and a data driver electrically connected to the gamma voltage generator, electrically connected to the controller, configured to generate data signals based on the output image data and the generated gamma voltages, and configured to supply the data signals to the display panel through the data lines, wherein the input image data includes a first grayscale for the first pixel, a second grayscale for the second pixel, and a third grayscale for the third pixel, wherein the provided gamma voltages include a first provided gamma voltage, a second provided gamma voltage, and a third provided gamma voltages respectively corresponding to the first grayscale, the second grayscale, and the third grayscale, wherein the generated gamma voltages include a first generated gamma voltage, a second generated gamma voltage, and a third generated gamma voltages respectively corresponding to the first grayscale, the second grayscale, and the third grayscale, and wherein a ratio of the first generated gamma voltage to the first provided gamma voltage, a ratio of the second generated gamma voltage to the second provided gamma voltage, and a ratio of the third generated gamma voltage to the third gamma provided voltage are different from one another.

13. The display device of claim 12, wherein the display panel operates in one of a first mode in which the data signals are supplied at a first frequency and a second mode in which the data signals are supplied at a second frequency lower than the first frequency, and wherein the gamma voltage generator generates the generated gamma voltages in the second mode.

14. The display device of claim 13, wherein the first generated gamma voltage, the second generated gamma voltage, and the third generated gamma voltage are respectively less than the first provided gamma voltage, the second provided gamma voltage, and the third provided gamma voltage in the second mode.

15. The display device of claim 14, wherein a difference between the first provided gamma voltage and the first generated gamma voltage increases as the magnitude of the second frequency decreases in the second mode.

16. The display device of claim 12, wherein when the first grayscale, the second grayscale, and the third grayscale included in the input image data are equal to one another, luminance of the first pixel, luminance of the second pixel, and luminance of the third pixel are different from one another according to the generated gamma voltages.

17. The display device of claim 14, wherein the first pixel emits red light, the second pixel emits green light, and the third pixel emits blue light.

18. The display device of claim 17, wherein in the second mode, a difference between the first provided gamma voltage and the first generated gamma voltage is greater than that between the third provided gamma voltage and the third generated gamma voltage, and a difference between the second provided gamma voltage and the second generated gamma voltage is greater than that between the first provided gamma voltage and the first generated gamma voltage.

19. The display device of claim 12, wherein the gamma voltage generator includes:

an image analyzer configured to generate frequency data by analyzing the frequency at which the display panel is driven, based on the input image data; and a data extractor configured to extract the first grayscale, the second grayscale, and the third grayscale included in the input image data.

20. The display device of claim 19, wherein the generated gamma voltage generator is configured to generate the first generated gamma voltage, the second generated gamma voltage, and the third generated gamma voltage according to the first grayscale, the second grayscale, and the third grayscale and based on the frequency data.

* * * * *